US007118301B2

(12) United States Patent
Toguchi

(10) Patent No.: US 7,118,301 B2
(45) Date of Patent: Oct. 10, 2006

(54) CONNECTION MEANS FOR BOXES

(76) Inventor: Yoshiaki Toguchi, 3-18-8, Makiminato, Urasoe-shi, Okinawa (JP)

( * ) Notice: Subject to any disclaimer, the term of this patent is extended or adjusted under 35 U.S.C. 154(b) by 224 days.

(21) Appl. No.: 10/927,354

(22) Filed: Aug. 27, 2004

(65) Prior Publication Data

US 2005/0034417 A1 Feb. 17, 2005

(30) Foreign Application Priority Data

Mar. 4, 2003 (JP) ..... 2003-56787

(51) Int. Cl.
*B25G 3/18* (2006.01)
*F16B 21/00* (2006.01)
*F16D 1/00* (2006.01)

(52) U.S. Cl. ..... 403/321; 403/325; 403/408.1; 403/DIG. 14; 292/210; 292/108

(58) Field of Classification Search ..... 292/195, 292/198, 210, 206, 304, 108, 105; 403/321, 403/408.1, DIG. 14, 325, 322.3, 322.4; 220/1.5; 206/509, 512, 511
See application file for complete search history.

(56) References Cited

U.S. PATENT DOCUMENTS 2,873,134 A * 2/1959 Ahlgren ..... 292/111
4,040,653 A * 8/1977 Takahashi ..... 292/202
5,549,241 A * 8/1996 Correll ..... 229/120.01
5,622,395 A * 4/1997 Shine et al. ..... 292/125
5,678,948 A * 10/1997 White ..... 403/321
5,927,766 A * 7/1999 Rosen ..... 292/101
6,913,297 B1 * 7/2005 Jackson et al. ..... 292/196

* cited by examiner

*Primary Examiner*—Daniel P. Stodola
*Assistant Examiner*—Nahdi Amiri
(74) *Attorney, Agent, or Firm*—Ronald E. Greigg

(57) ABSTRACT

The connection assembly for boxes includes a connection support which connects integrally a base plate and a cover plate which faces to the base plate upwardly via a predetermined space; a rotary shaft member which is supported pivotably by and perpendicular to the base plate and the cover plate; an engage piece which is installed into the predetermined space at a horizontal state, capable of rotating with the rotary shaft member together; a return spring, a center part thereof wound around the rotary shaft member and both ends thereof supported by a spring pressure part of the rotary shaft member and an engage piece of the base plate; a lock piece for the engage piece, an end part thereof which is supported pivotably by a fixed shaft which is provided at one side of the base plate, having an engage part which projects from an upper surface of the base plate; and a spring which is attached to the fixed shaft, capable of biasing the lock piece to an engagement direction. Therefore, it is not uncoupled easily at an engagement state when in earthquake, and it can uncouple easily at the engagement state.

7 Claims, 14 Drawing Sheets

CONNECTION MEANS FOR BOXES

BACKGROUND OF THE INVENTION

1. Field of the Invention

The present invention relates generally to a connection means for boxes after the connection means is attached to the top plate of the boxes when the boxes such as storing boxes, arrangement boxes and containers are positioned side-by-side.

2. Description of the Prior Art

The present inventor's Japanese published unexamined application No. 2002-284169 connection structure of a storing box as follows:

(1) The top plate member of a storing box consists of an inner plate and an outer plate fixed to the inner plate.

(2) A pair of engaging lock pieces is installed in the corners on the diagonal line of the top plate member respectively.

(3) The engaging lock pieces can project with passing through a inner space from cut parts for the engaging lock piece which are formed parts adjacent the two sides connection part of the top plate member respectively.

(4) An engaging lock arm that rotates at a predetermined angle engages with the cut part of the next box and engages with the corner part of the top plate member.

As a result of carrying out an earthquake-proof examination of the embodiment described above the engaging lock arm was revealed to have a weak point for the gap to the rotation direction. Then, the connection tool of the boxes that the engage state is maintained easily when in earthquake is demanded now.

SUMMARY OF THE INVENTION

Accordingly, it is an object of the present invention to provide a connection means for boxes which can be attached fixedly to a top plate of the box body and is strong. It is another object of the present invention to provide a connection means for boxes that can connect easily the boxes which are side-by-side. It is still another object of the present invention to provide a connection means for boxes which is not uncoupled easily at an engagement state under earthquake conditions. It is further object of the present invention to provide a connection means that can uncouple by one action when the connecting state is uncoupled and can go back the engage piece to the original position. It is a still further object of the present invention to provide a connection means for boxes that does not influence to a return spring for the engage piece even though the strong force is applied to the cover plate and rotary shaft from the upper direction.

The present invention is understood to encompass embodiments which include all or only a portion of the above objects, features and advantages which, unless recited in claims defining the invention, are understood not to limit interpretation of such claims. The above, and other objects, features and advantages of the present invention will become apparent from the following description read in conjunction with the accompanying drawings, in which like reference numerals designate the same elements.

It is to be expressly understood, however, that the drawings are for the purpose of illustration and description only, and are not intended as a definition of the limits of the invention.

BRIEF DESCRIPTION OF THE DRAWINGS

FIG. 1 is a top plan view showing the way in which the present invention is attached to a top plate of a box body;

FIG. 2 is a front view of the structure shown in FIG. 1;

FIG. 3 is a left side view thereof;

FIG. 4 is a view similar to FIG. 1, with a portion broken away to more clearly show other parts;

FIG. 5 is a bottom view;

FIG. 6 is an exploded perspective view of major part of the present invention;

FIG. 7 is a schematic cross-sectional view of major part of the present invention;

FIG. 8 is a schematic view showing the relationship between a lock piece for engagement and a supporting piece;

FIG. 9 is a schematic view showing the way in which an engage piece is rotated by an operation tool;

FIG. 10 is a schematic view showing the relationship between an engage piece and a lock piece;

FIG. 11 is an explanation view showing the way in which an engage piece engages with a connecting support of a connection means of a box body which is side-by-side;

FIG. 12 is an explanation view from front showing the way in which a lock piece is released by user's finger, FIG. 13 is an explanation view from top showing the way in which a lock piece is released by user's finger, and FIG. 14 is an explanation view showing the way in which an engage piece is rotated to the opposite direction.

DETAILED DESCRIPTION OF THE PREFERRED EMBODIMENTS

Figure 1:
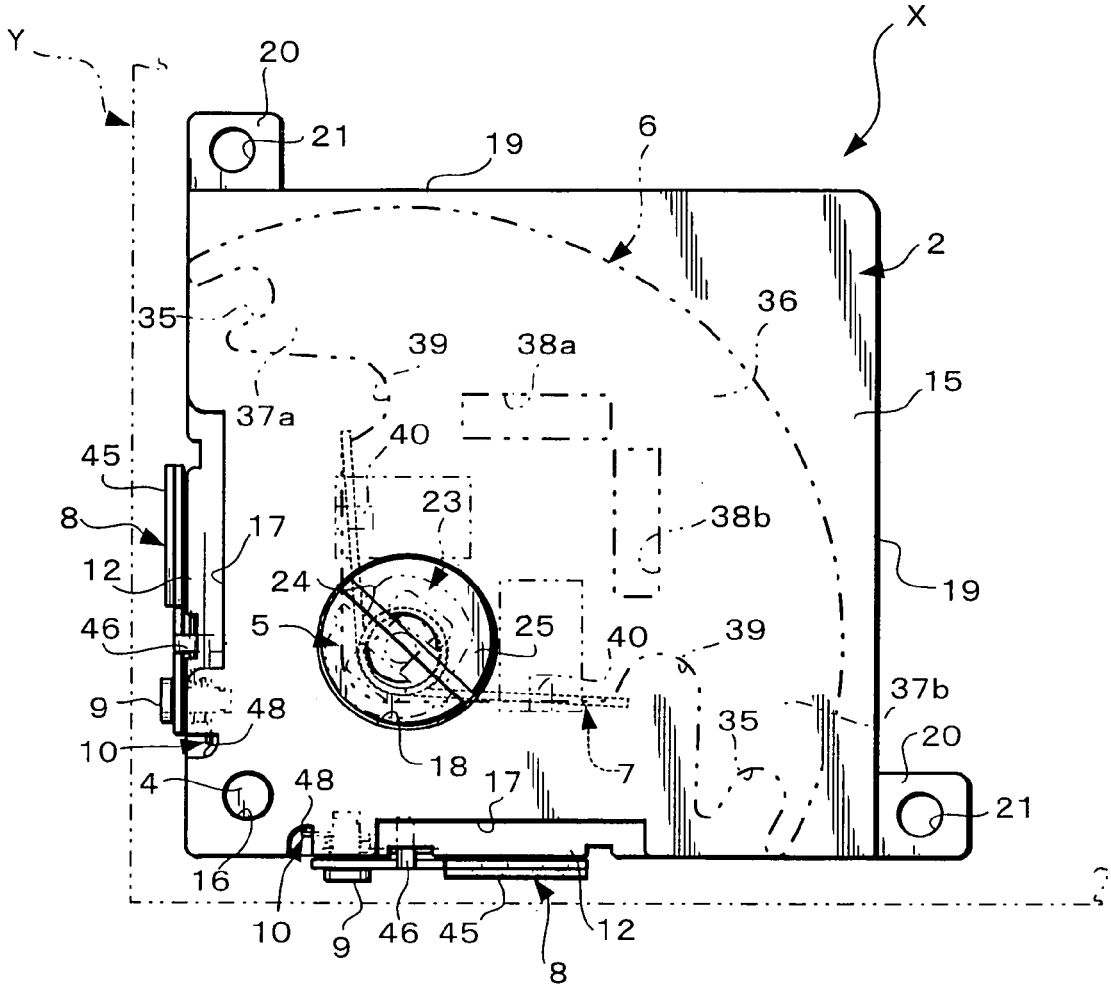
FIGS. 1 to 14 illustrates each explanation view showing an embodiment of the present invention.
Figure 2:
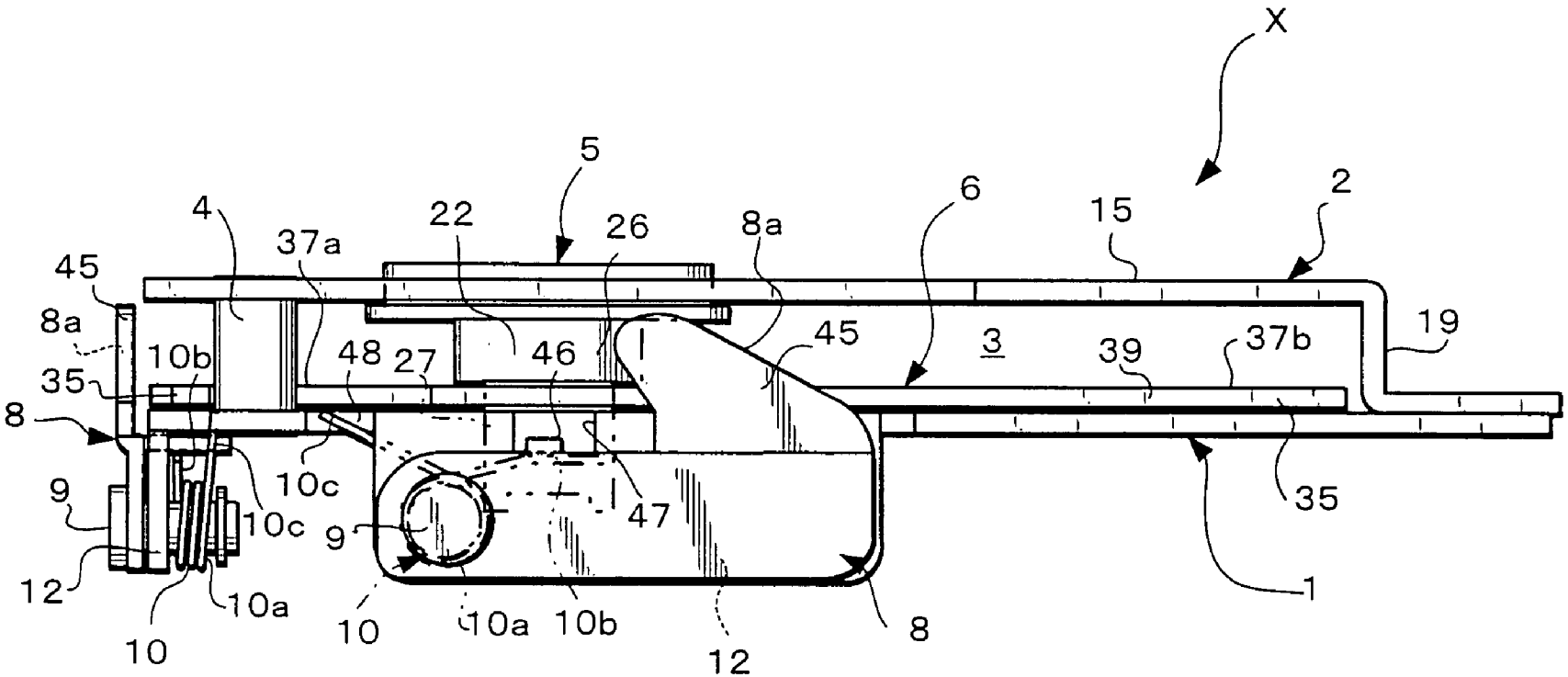
Figure 3:
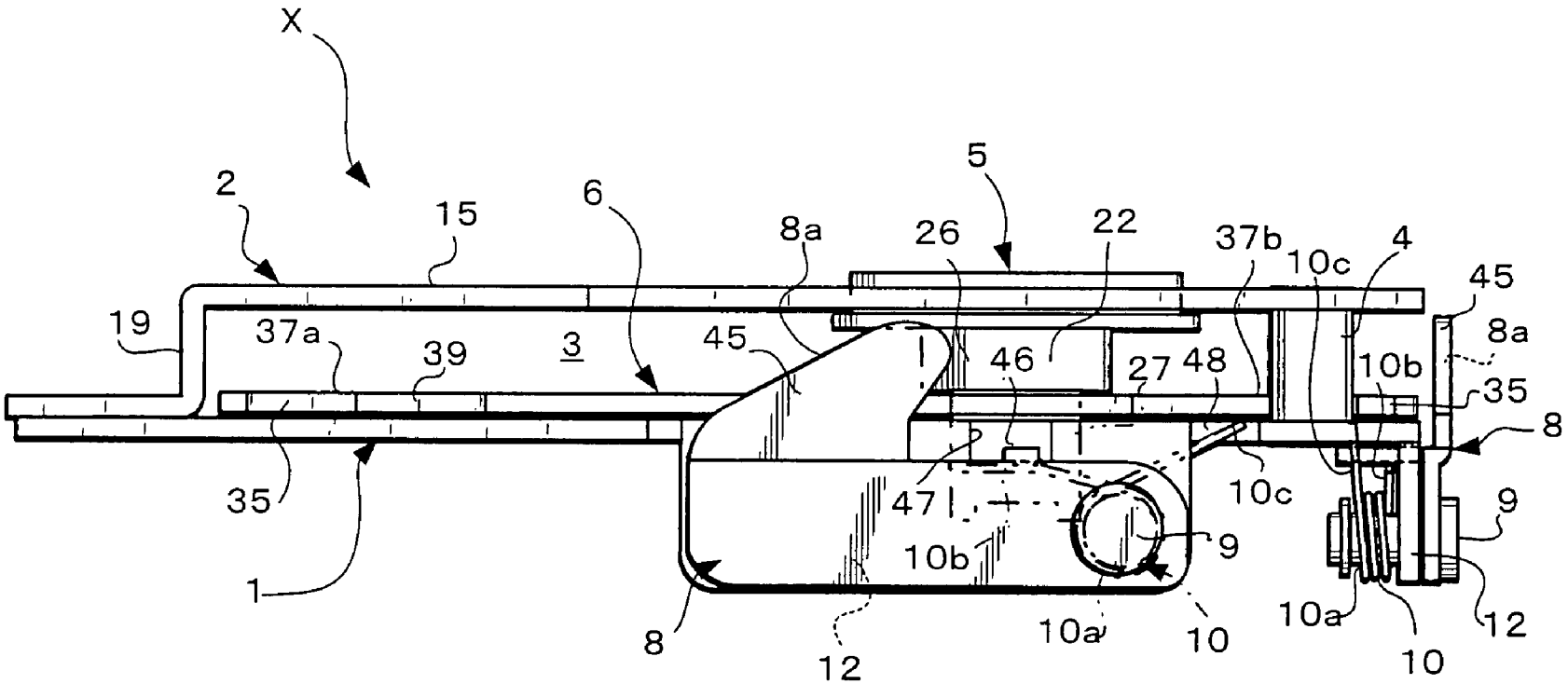
Figure 4:
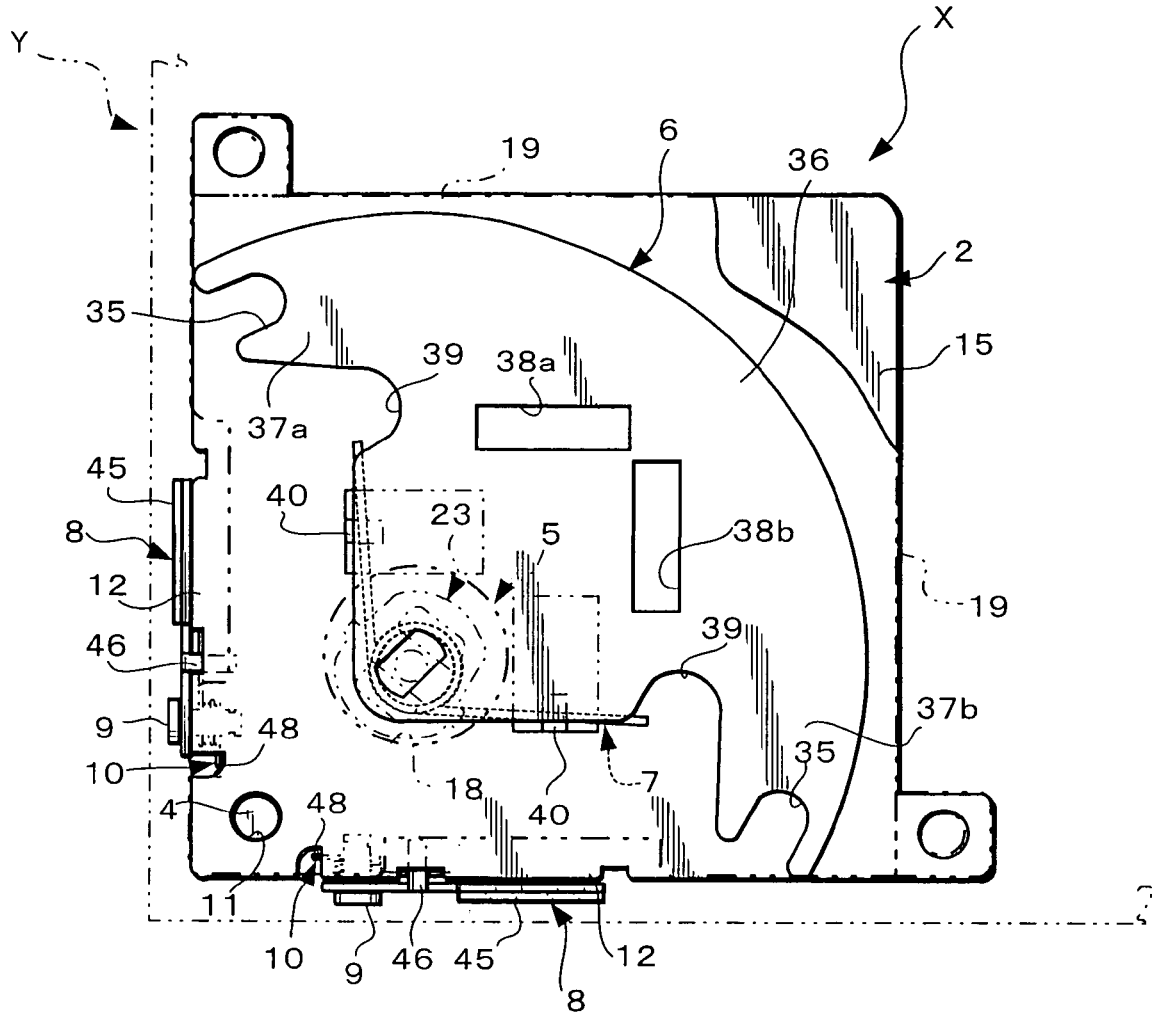
Figure 5:
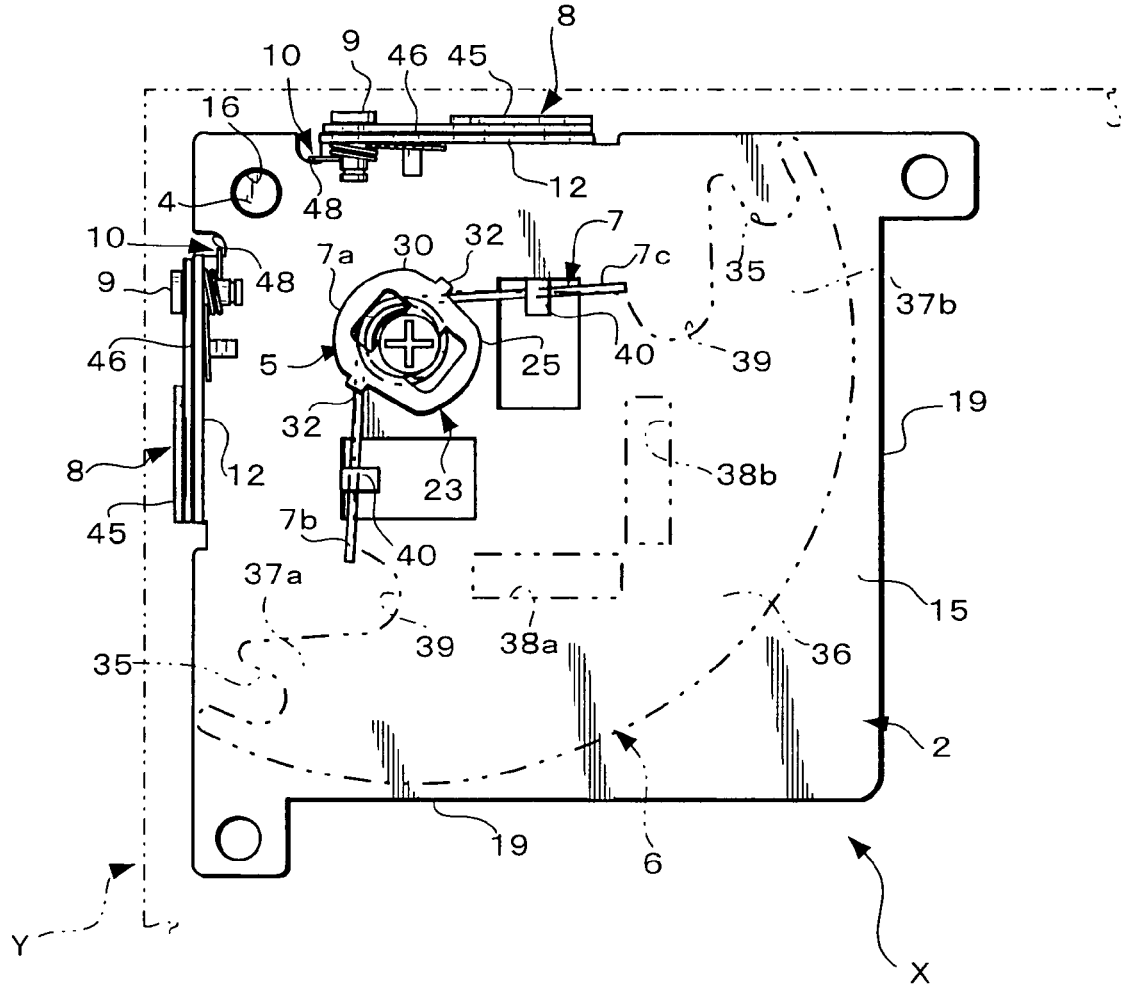

Preferred embodiments of the present invention are described in more detail below referring to the accompanying drawings. An understanding of the present invention may be best gained by reference FIGS. 1 to 14. Reference letter x is a connection tool as connection means that can connect boxes which are positioned side-by-side. The connection tool X is attached to a corner part of a top plate of a box body Y of the storing boxes, arrangement boxes and containers.

First, the specific features for this invention (essential features of elements) are explained briefly. Reference numeral 1 designates a base plate which is formed in the shape of a rectangle. Reference numeral 2 designates a cover plate which faces to the base plate 1 via a predetermined space 3 upwardly. Reference numeral 4 designates a connection support which connects the base plate 1 and the cover plate 2 integrally. Reference numeral 5 designates a rotary shaft member which is supported pivotably by the base plate 1 and the cover plate 2 at the perpendicular state. Reference numeral 6 designates an engage piece which is installed into the predetermined space 3 at a horizontal state so as to rotate with the rotary shaft member 5 together. Reference numeral 7 designates a return spring, a center part thereof wound around the rotary shaft member 5 and both ends thereof supported by a spring pressure part which is provided at the base plate 1 and rotary shaft member 5. Reference numeral 8 designates is a lock part for the engage piece 6, having an engage part which is projected from the upper surface of the base plate 1, an end part thereof which is supported pivotably by a fixed shaft 9 which is provided at one side of the base plate 1. Reference numeral 10 designates a spring which is attached to the fixed shaft 9 so as to bias the lock piece 8 to the engagement direction. Next, each member is explained in detail.

The base plate 1 is formed in the shape of a rectangle with metal. Reference numeral 11 designates a hole for attaching the connection support 4, forming at one corner thereof. Reference numeral 12 designates support piece for the fixed shaft 9, the support piece 12 formed with bending downward a part of two sides (edges) which positions a part which the hole 11 or the connection support 4 intersects. Reference numeral 13 designates a shaft hole for the rotary shaft member 5, which is formed in a part adjacent the corner of the hole 11 side. Other composition is described later.

The cover plate 2 is also formed with metal. Reference numeral 15 designates a cover part which is formed in the shape of a rectangle, which faces to the base plate 1. As shown in the plan view of FIG. 1, an attachment hole 16 for connection support 4 is formed at one of the corner of the cover part 15. Reference numeral 17 designates cut-outs for pushing the lock piece, the cut-outs 17 forming at a part of two sides (edges) which positions a part which the attachment hole 16 or the connection support 4 intersects. These cut-outs 17, 17 have predetermined width and length which can put one finger at least thereinto.

Reference numeral 18 designates a fitting hole for the rotary shaft member, which is located above the shaft hole 13 of the base plate 1. The diameter of the fitting hole 18 is larger than that of the shaft hole 13. Reference numerals 19, 19 designate side walls which intersect perpendicularly with the cover part 15 and are formed by bending downward two sides (edges) which are spaced from the cut-outs 17, 17 respectively. Reference numerals 20, 20 designate attachment parts or tabs which are formed and projected at one end of the side walls 19, 19 respectively, having screw holes 21, 21 for fixing implements which are not illustrated.

The connection support 4 is attached to one of the corner parts of the connection means X via the attachment holes 11, 16, having a function as the engage pin which engages with and releases the engage piece 6 of the same connection means X, X which are attached in the box bodies Y, Y which are positioned side-by-side. In addition, the connection support 4 also has a function that connects the base plate 1 and the cover plate 2 toughly.

Figure 6:
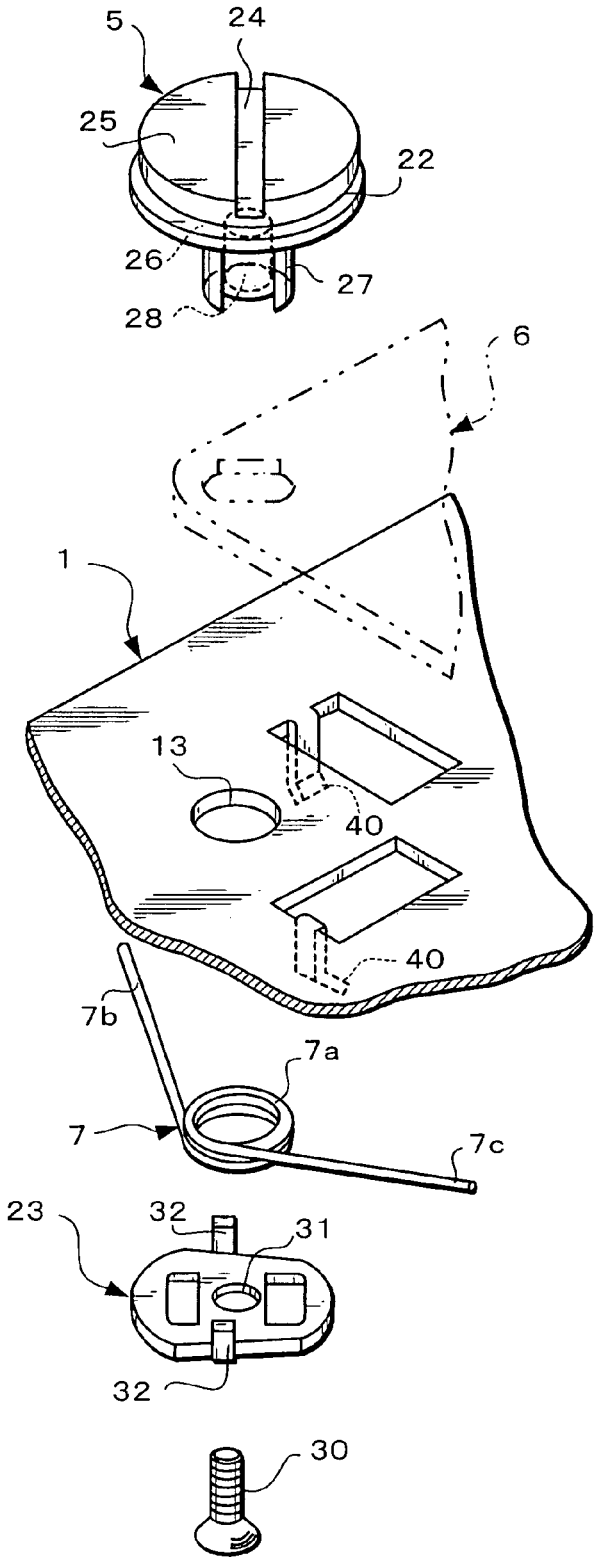

For the rotary shaft assembly the rotary member 5, return spring 7 and fixing implement 30 are shown in FIG. 6. The rotary shaft member 5 consists of a shaft body 22 and a support plate 23 for the spring 7. The shaft body 22 is attached adjacent the corner part of the base plate 1 at the perpendicular state. The support plate 23 is attached fixedly to a lower end part which is passed through the base plate 1, supporting the return spring 7 which is provided along with a bottom surface of the base plate 1.

The shaft body 22 consists of a flat head part 25 having a slot 24 (for example, level slot) on the upper surface thereof; a body part 26 with large diameter, which connects continuously to the head part 25; and a leg part 27 with small diameter which connects continuously to the body part 26, having a screwed hole 28 which formed at the lower end surface thereof.

Figure 7:
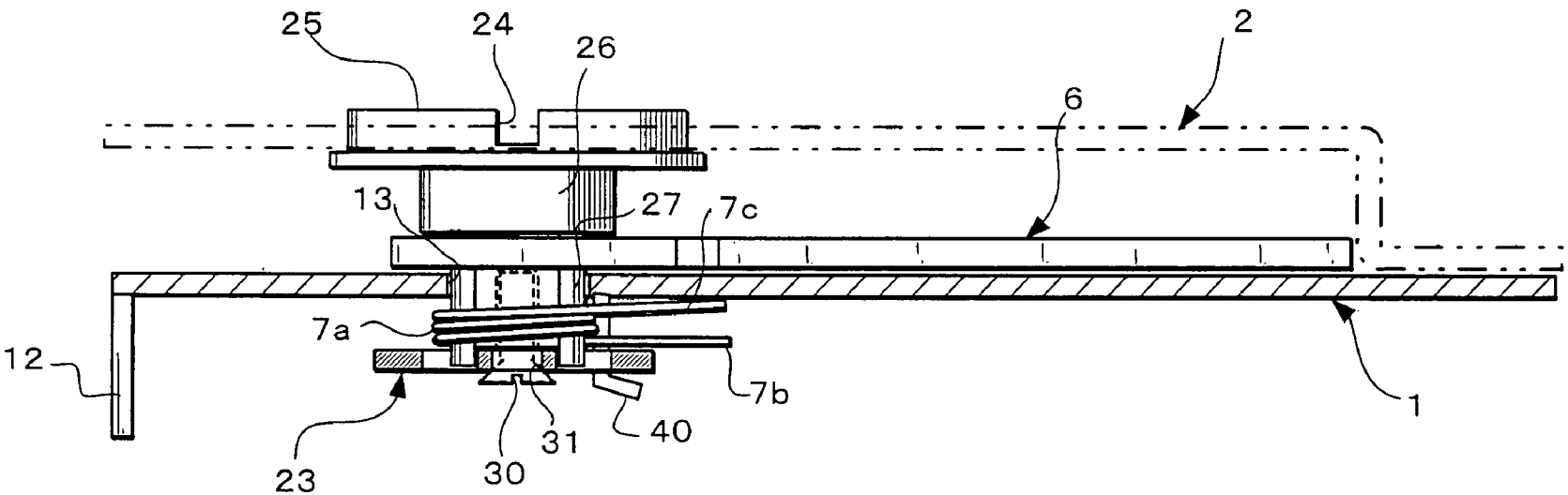
Figure 8:
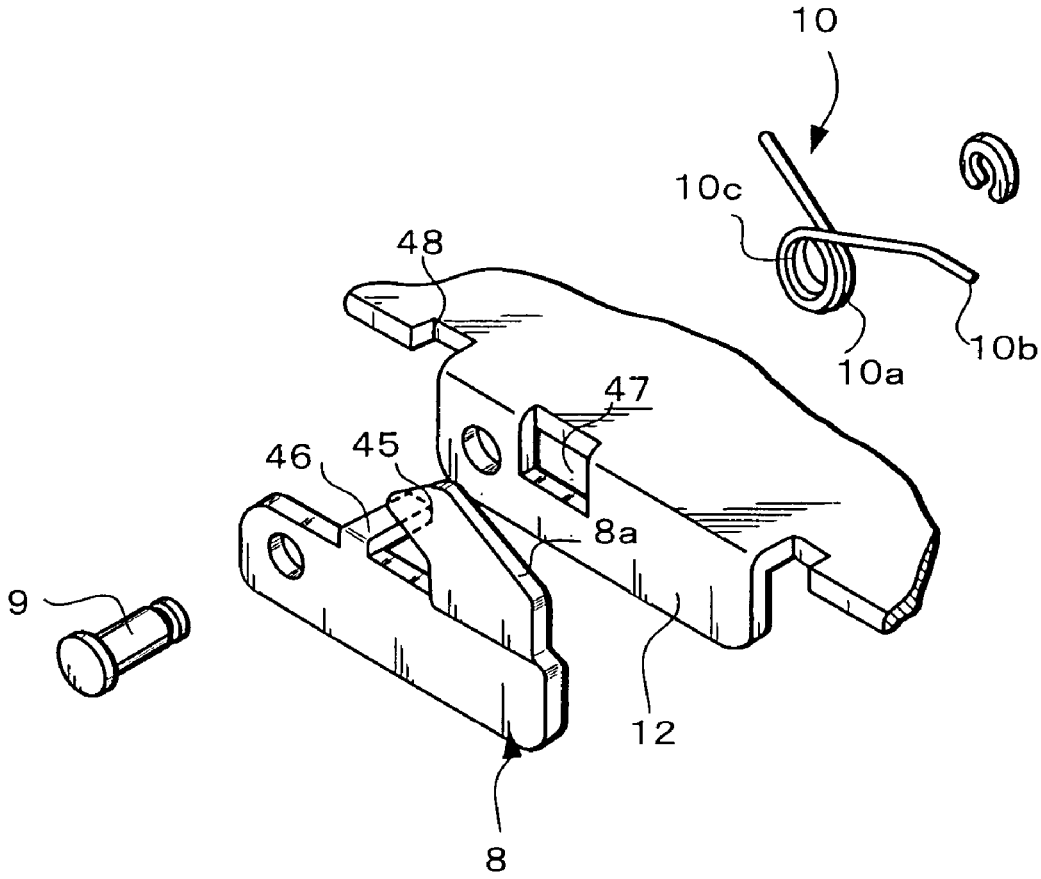
Figure 9:
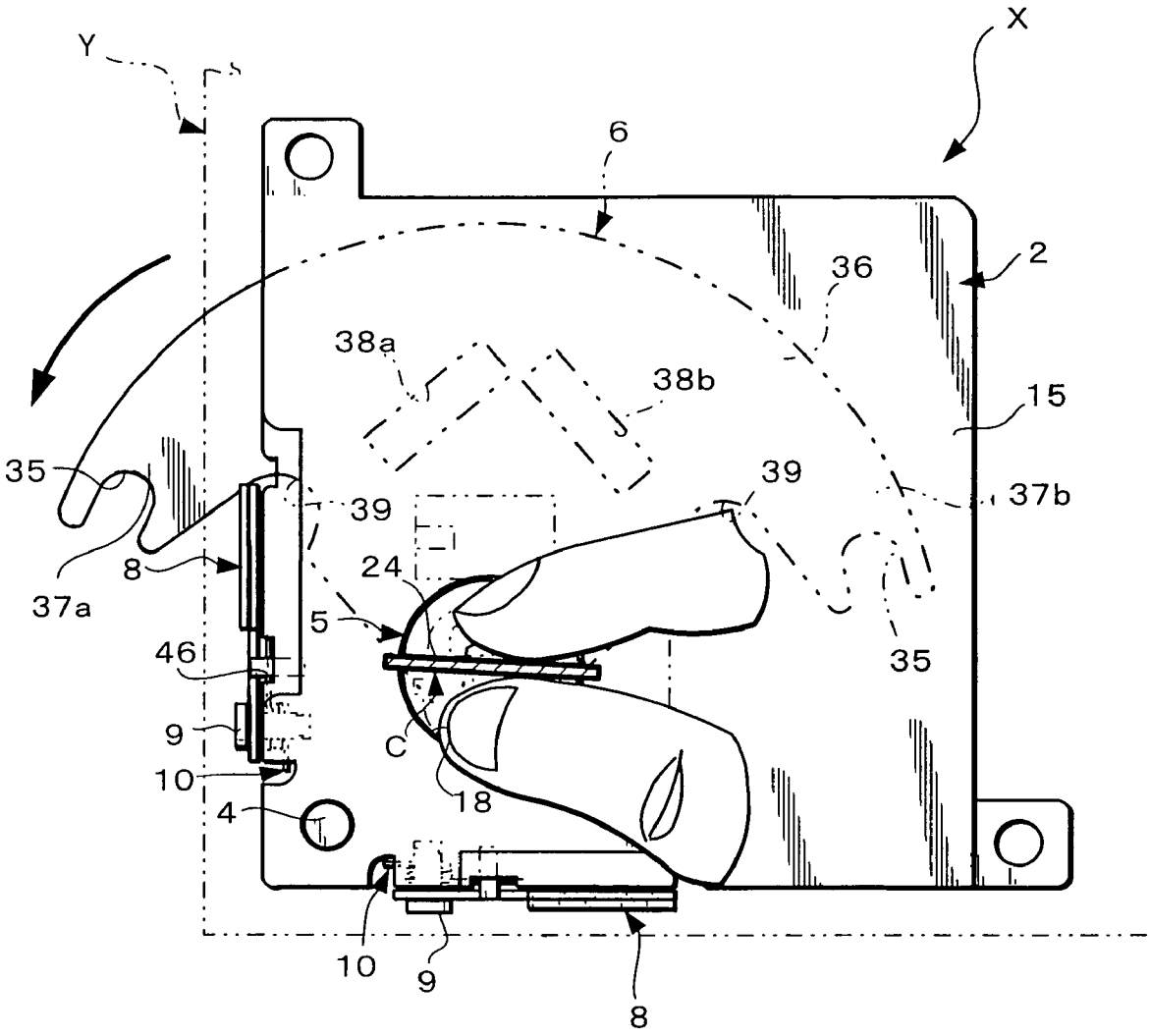
Figure 10:
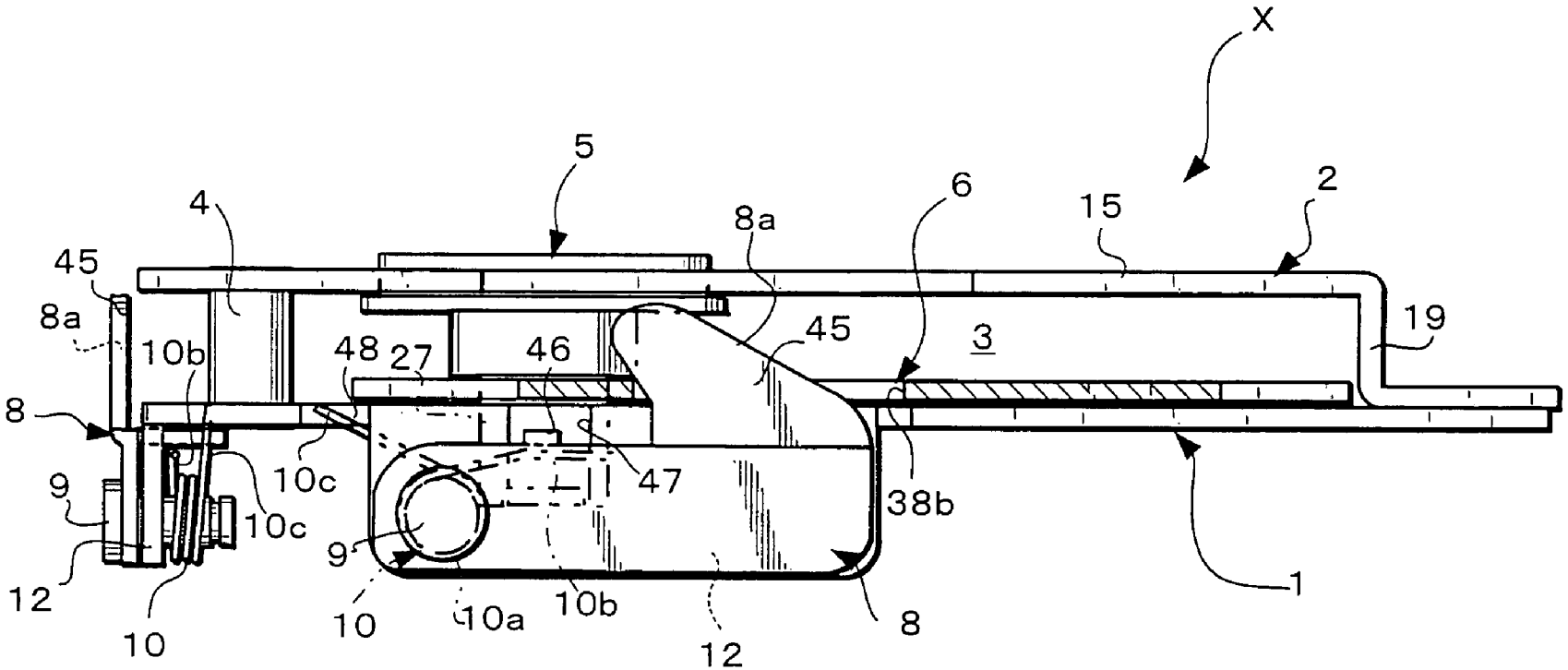
Figure 11:
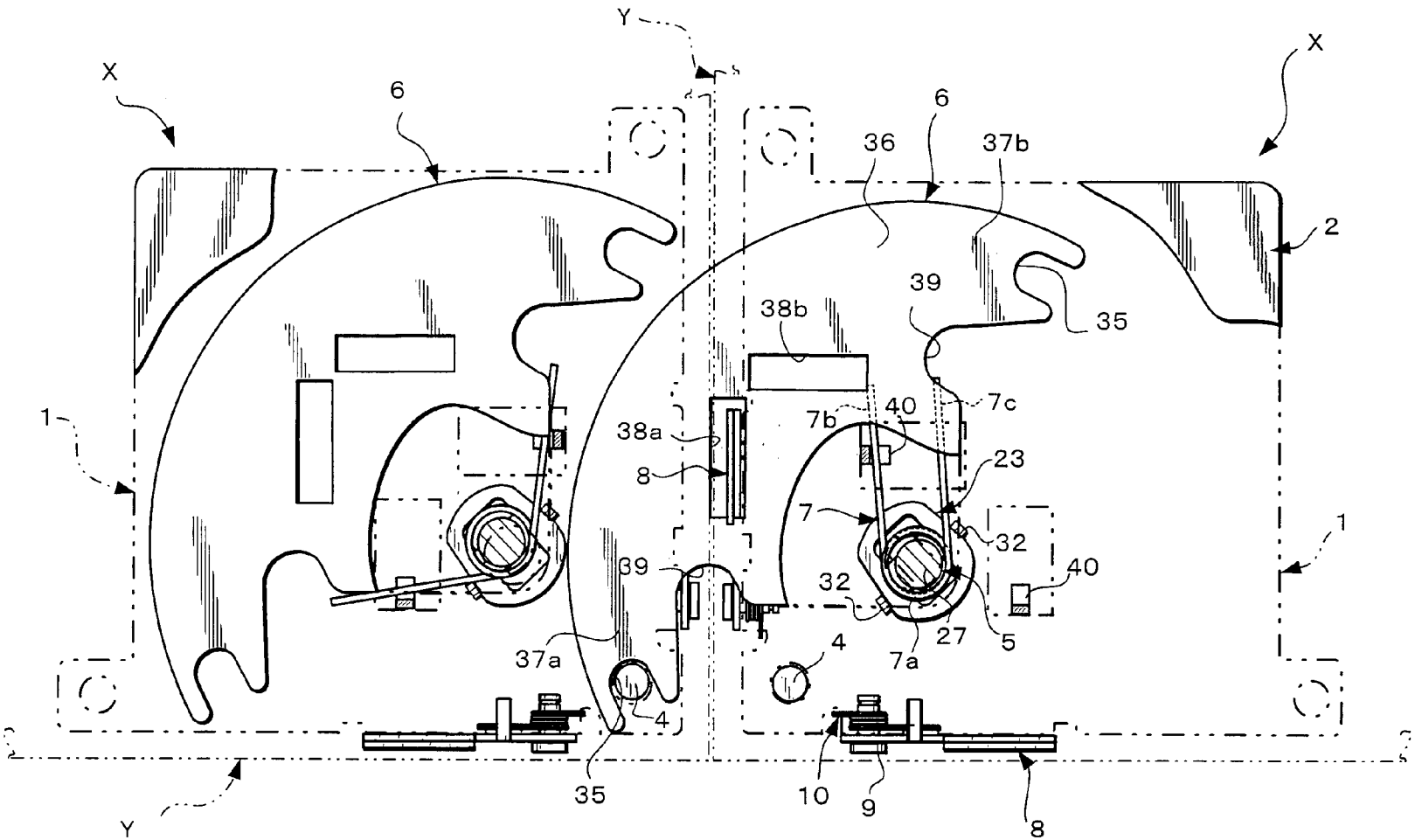
Figure 12:
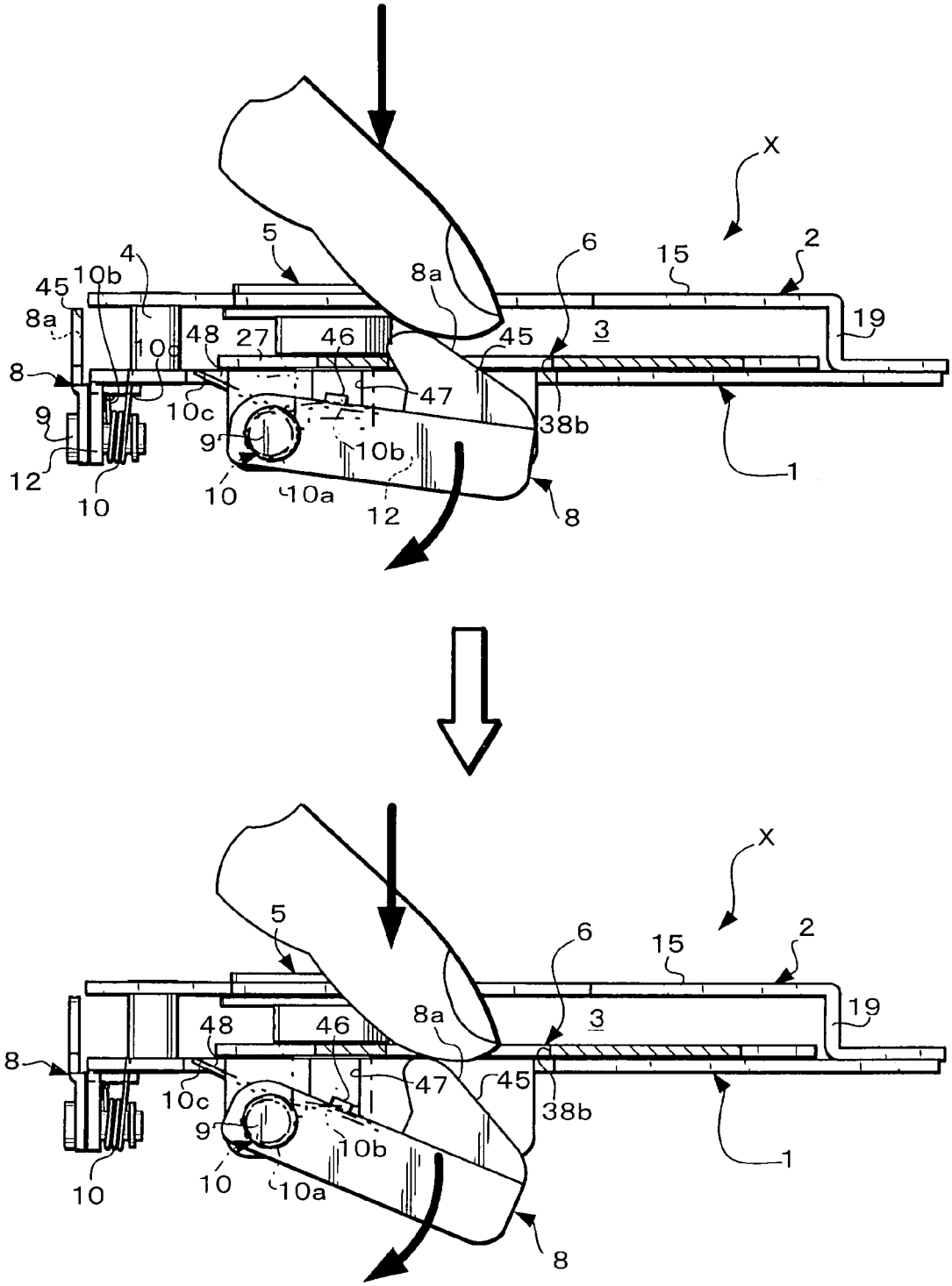
Figure 13:
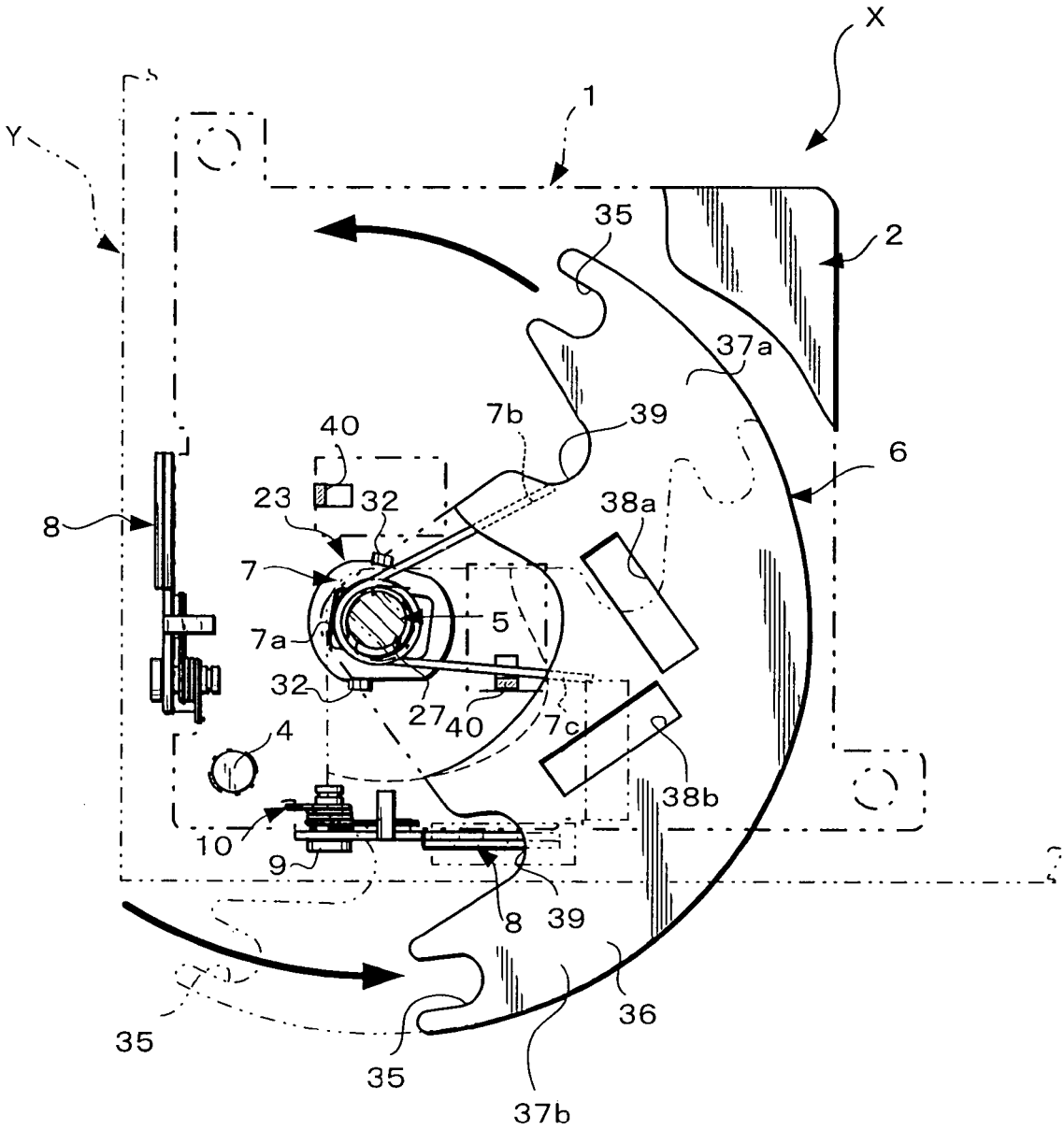
Figure 14:
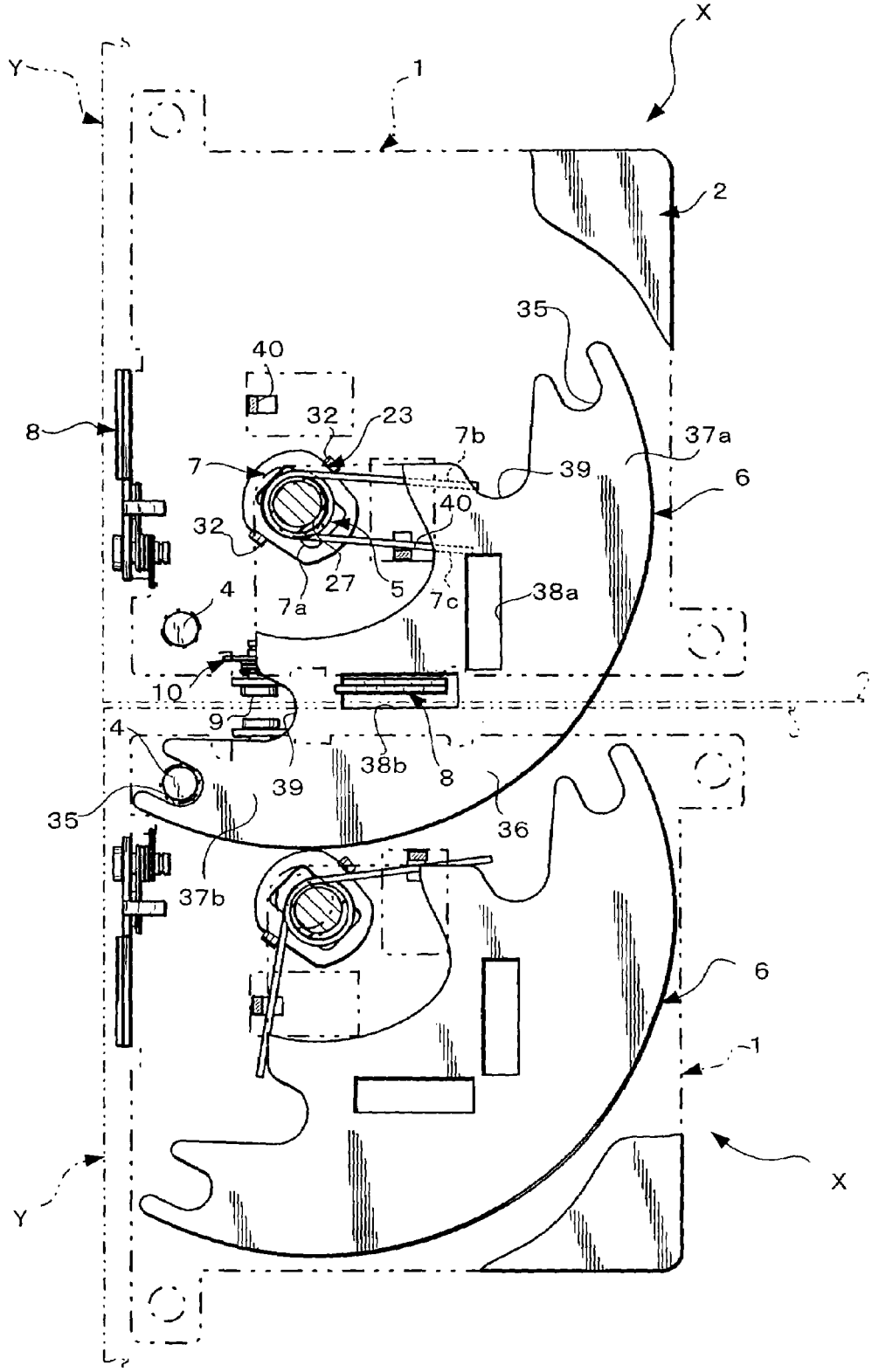

Moreover, the spring support plate 23 is formed in the desired shape (for example, horseshoe shape). A through hole 31 for the fixing implement 30 is formed in a central part thereof. Moreover, a pair of spring press parts or tabs 32, 32 is provided and project from the side parts of the circumferential edge. As shown in FIG. 7, the spring support plate 23 is attached fixedly to the shaft body 22 through the fixing implement 30 at a level state.

The engage piece 6 engages with the rotary shaft member 5 via a rectangular or elliptical shaft hole, and an engaged part 35 which engages and releases with the connection support 4 of the box body Y is formed in at least one of the end parts thereof. The engaged part 35 in this embodiment designates the cut part which is formed in the shape of an U-letter, and it makes to image like the opened thumbs and index fingers. The engaged parts 35 are formed in both ends 37*a*, 37*b* formed in the shape of an arc, which project symmetrically from a broad portion 36 respectively.

In addition, a plurality of engaged windows 38*a*, 38*b* which engage and release with the pair of lock pieces 8, 8 respectively are formed in a suitable part of the broad portion 36. In this embodiment, the engaged window 38*a*, which is formed in the shape of an elongated rectangle, positioned at the left end of part 37*a*, is defined as the first engaged window (basis in FIG. 4). On the other hand, the engaged window 38*b*, which is in the shape of an elongated rectangle positioned generally perpendicular to part 38*a* at the right end of part 37*a*, is defined the second engaged window. Therefore, the engaged window 38*a* of the direction of the X-axis and the engaged window 38*b* of the direction of the Y-axis cross in section on a line.

As shown in FIG. 7, the return spring 7 is positioned between the upper surface of the spring support plate 23 of the rotary shaft member 5 and the bottom surface of the base plate 1. Then, even if the rotary shaft member 5 is pressed under earthquake conditions, it is improved so that the return spring 7 is not given the influence.

The central part 7*a* of the return spring 7 is wound around the leg part 27 of the rotary shaft member 5 which projects from the bottom surface of the base plate 1. Both end parts 7*b*, 7*c* thereof are supported by a pair of engage pieces or tabs 40, 40 which are formed and projected in the base plate 1 and the spring pressing part of the rotary shaft member 5 respectively.

In this embodiment, when the engage piece 6 rotates to a clockwise rotation or a counterclockwise rotation, the spring power of the return spring 7 acts. The both ends 7*b*, 7*c* of the return spring 7 always presses to the engage pieces 40, 40 of the base plate 1 at an expanded state respectively. Since the rotary shaft member 5 also rotates together when the engage piece 40 rotates to the engaging direction, one of the end part 7*b* (7*c*) is supported by one of the engage piece 40, and another end part 7*c* (7*b*) is pushed by the spring press part 32 of the spring support plate 23 and moves (elastic modification function).

On the other hand, when the engage piece 40 is released from the lock piece 8 at the engagement state, the moved end part 7*b* (7*c*) returns to the original position which press to the engage piece 40 (elastic modification return function).

The lock pieces 8 for the engage piece is symmetrically arranged to one side of the base plate 1 through the support pieces 12, and the fixed shafts 9, which are formed at another side which intersects perpendicularly with the one side of the base plate 1 respectively in this embodiment. On end portion of the lock piece 8 is supported by the fixed shaft 9 provided in one side of the base plate 1, and the engage part 45, which is formed in the shape of a hook, always projects from the upper surface of the base plate 1.

Then, a thin spring support piece 46 is formed and projected horizontally at the upper side part adjacent the on end portion of the lock piece 8. The spring support piece 46 enters into a small window 47 which is formed in the support piece 12 and can touch the bottom surface of the base plate 1, thereby limiting the pivotal movement of lock piece 8.

The spring 10 always biases the lock piece 8 to the engaging direction. In this embodiment, the central part 10*a* is wound around the fixed shaft 9, and the end part 10*b* is supported by the bottom surface of the spring support piece 46 of the lock piece 8. Another end part 10*c* of the spring 10 is supported by a small cut part 48 for the spring support part, the cut part 48 formed a part near the connection support of the base plate 1.

For the above-mentioned composition, when the box bodies Y, Y next to each other are connected to the right and left directions or front and back directions via the connection implement X suitably fixed to the corner part of the top plate of the box body Y, an operation tool C (coin, screwdriver, etc.) is inserted in the slot 24 of the head of the rotary shaft member 5, and it rotates to a clock or a counterclockwise direction.

Then, the rotary shaft member 5 rotates. When the rotary shaft member 5 rotates, the engage piece 6 of the rotary shaft member 5 rotates against the spring power of the return spring 7. Then, the one end part 7*b* (7*c*) of the return spring 7 is pushed on the spring press part 32 of the spring support plate 23 and moves. Therefore, the one end part 7*b* (7*c*) of the return spring 7 against the spring power and approaches other ends.

By the way, when the engage piece 6 projects from the base plate 1 and the cover plate 2 as it rotates, the arc edge 39 in the side of the end parts 37*a* (37*b*) attaches the inclination partial 8*a* of the lock piece 8. Then the engage piece 6 rotates to the engage direction so that the arc edge 39 of the engage piece 6 attaches slidably the inclination part 8*a* of the lock piece 8, and the lock piece 8 is depressed against the spring power of the spring 10.

In addition, when the engage piece 6 rotates to a predetermined connection position, the lock piece 8 which is depressed by the lock piece during the engage piece 6 rotation, returns according to the spring power of the spring 10, and it engages with the engaged part 38*a* (38*b*) of the engage piece 8.

On the other hand, when the lock state of the lock piece 8 is released, the engage part 45 is depressed as the finger is put into the cut-out 17 of the cover plate 2. After it does so, since the lock piece 8 rotates to a lower position about the fulcrum in the fixed axis 9, the engage part 45 is released from the engaged window 38 of the engage piece 6. Consequently, the engage piece 6 returns to an initial position automatically according to the spring power of the return spring 7.

For the box body such as the storing boxes, arrangement boxes and containers are positioned side-by-side, when the connection means is attached to the top plate of the box body, it is attached to the corner part etc. of the top plate suitably. After the part of the corner part of the top plate is cut, and the connection tool X as the connection means of the present invention is fixed to the cut portion with means for adhering, fixing tools, and the like. In addition, the connection tool X is fixed so as to attach along with the bottom surface of the corner part of the top plate. In this case, the fitting hole is formed at the corner part, the hole fitting the head part 25 of the shaft body 22 of the rotary shaft member 5.

Moreover, two or more connection tool X may suitably be fixed to the corner part of the top plate of the box body when the user wants to make a documents shelf with arrangement in parallel side by side of the box body having the same shape. Then, the box body can be mutually connected to the right and left directions or forward and backward directions via the connection tool X.

As set forth above, the advantages of the invention are as follows:

(1) The connection implement can be fixed to the top plate of the box body. In addition, the base plate and cover plate are connected by the connection support integrally so that it is strong.

(2) The box body arranged side-by-side can be connected easily via the use of operation tools such as coins or the like.

(3) The engage part always engages with the engaged window of the engage piece so that it is hard to release the engagement state between the engage part and the engaged window even under earthquake conditions.

(4) When the connection state is desired to be released, engagement can be released with only one finger, that is one action. In addition, the engage piece returns automatically to the initial position.

(5) For one embodiment of the invention the connection support has not only the function for connection between the base plate and the cover plate, but also the function for engaging the engage pin of an adjacent connection means when the boxes are arranged in parallel.

(6) For another embodiment of the invention since the return spring for the engage piece is provided at the bottom surface sides even though strong force is applied to the cover plate and rotary shaft member from the upper direction, there are few instances of malfunction.

Box bodies can be connected by one connection means from front to back and from side to side.

The foregoing relates to preferred exemplary embodiments of the invention, it being understood that other variants and embodiments thereof are possible within the spirit and scope of the invention, the latter being defined by the appended claims.

What is claimed is:

1. A connection assembly for boxes comprising:

a base plate and a cover plate, a connection support which connects integrally the base plate and the cover plate in spaced, generally parallel relation to define a predetermined space therebetween;

a rotary shaft member which is supported pivotably by the base plate and the cover plate at a perpendicular location;

an engage piece which is installed into the predetermined space generally parallel to the base plate and cover plate, the engage piece being capable of rotating together with the rotary shaft member, a return spring having a center part wound around the rotary shaft member and having two ends supported one by a spring pressure part of the rotary shaft member and one by an engage piece of the base plate;

a fixed shaft at one side of the base plate, a lock piece locking the engage piece, the lock piece being supported pivotably by the fixed shaft and having an engage part which projects from an upper surface of the base plate; and a spring which is attached to the fixed shaft, capable of biasing the lock piece to an engagement direction.

2. A connection assembly for boxes according to claim 1, further comprising:

said return spring biasing the rotary shaft member for rotation when box bodies which are positioned side by side are connected;

the lock piece which is depressed by engagement with the engage piece rotates to return according to the spring power of the spring to engage with an engaged part of the engage piece when the engage piece rotates to a predetermined connection position; and the engage piece returns to an initial position according to the spring power of the return spring when the lock state is released after the engaged part of a lock piece is depressed.

3. A connection for boxes according to claim 1, wherein the engage piece is formed in the shape of a fan pivoted at its base by the rotary shaft member, at least one end part of the fan forming an engaged part which is engaged with and released from the connection support of the connection assembly which is installed with a box body which is positioned side-by-side.

4. A connection for boxes according to claim 1, wherein the connection support is provided at the corner part of the connection having a function of a fitting pin which engages with and releases from the engage piece of the connection assembly which is installed into a box body which is positioned side-by-side.

5. A connection assembly for boxes according to claim 1, wherein the rotary shaft member further includes a shaft body which is attached adjacent a corner part of the base plate and perpendicular thereto, and a support plate for the return spring attached fixedly to a lower end part of the rotary shaft which is passed through the base plate and supporting the return spring which is positioned between the support plate and a bottom surface of the base plate.

6. A connection assembly for boxes according to claim 1, wherein the lock piece comprises a first lock piece and a second lock piece, the first lock piece is disposed to one side of the base plate through a first support, the second lock piece is disposed on another side of the base plate through a second support piece which is perpendicular with respect to the first lock piece and a plurality of engaged windows which engage with and releases from the first and second lock pieces respectively and are formed in the engage piece which is shaped in the form of an arc.

7. A connection assembly for boxes according to claim 6, wherein the cover plate further includes cut parts for pushing the lock piece, the cut part being formed in a part of at least one side of the cover plate.

* * * * *